United States Patent [19]

Franks

[11] 4,257,571

[45] Mar. 24, 1981

[54] FOUNDATION CLIP ASSEMBLY

[75] Inventor: Virgil D. Franks, Mesa, Ariz.

[73] Assignee: Charles E. Cates, Phoenix, Ariz. ; a part interest

[21] Appl. No.: 894,866

[22] Filed: Apr. 10, 1978

[51] Int. Cl.[3] ..... E04G 17/00; E04G 17/02

[52] U.S. Cl. ..... 249/207; 249/34; 249/177; 249/183; 249/219 R

[58] Field of Search ..... 249/34, 207, 219 R, 249/177, 183

[56] References Cited

U.S. PATENT DOCUMENTS

| | | | |
|---|---|---|---|
| 2,973,567 | 3/1961 | Brow, Jr. et al. | 249/219 R |
| 3,722,849 | 3/1973 | Luyben | 249/219 R |

*Primary Examiner*—Lester L. Lee

*Attorney, Agent, or Firm*—Charles E. Cates

[57] ABSTRACT

The disclosure teaches a novel foundation clip assembly comprising a foundation clip having a web and two upturned ends integral with said web in combination with a sleeve means covering a central part of the web. Also, a novel method of constructing a foundation stem on a footing is taught which comprises the steps of providing foundation clips and sleeves; inserting the clips in the sleeves; positioning the clips and sleeves on the footing to receive concrete forms; inserting concrete forms in the clips; pouring the concrete in the forms; removing the forms when the concrete sets up; and finally removing said clips from said sleeves for further use.

7 Claims, 12 Drawing Figures

FOUNDATION CLIP ASSEMBLY

BACKGROUND OF THE INVENTION

This invention relates to foundation form clips for locating and securing concrete forms used in pouring foundations and the like, and particularly to such devices and methods useful in constructing stems on footings.

Foundation form clips are known in the prior art. For example, see U.S. Pat. No. 2,973,567 to Arthur J. Brow, Jr. and Oscar L. Franks, dated Mar. 7, 1961, which discloses a foundation form clip having a main base portion and upturned ends, and upturned wings formed intermediate the ends by punching out triangular portions of the base portion. That patent also teaches the use of the clip on a footing which is to be secured thereto by driving nails in the apex of the triangle; (In practice, sometimes the nails are used to secure the clips to the footing and sometimes they are not.) then placing forms in the space between the ends and the wings. The tops are secured by similar clips and the concrete stem is poured between the forms. Such clips are very useful and are time savers, but a problem is that the bottom clips must be left under the stem. Their presence ordinarily is not a problem because that portion of the stem is covered over. In some instances, however, the clips are exposed and then the ends thereof must be cut off to present a smooth stem surface. In any event, the clips which currently cost between $.15 and $.20 apiece are used up in the process of constructing the stem on the footing and over a period of time the expense of these clips amount to a great deal of money. These problems are solved by means of the invention described and claimed hereafter.

BRIEF DESCRIPTION OF THE INVENTION

According to the teachings of the invention of this application, a novel foundation clip assembly is provided whose cooperating elements are a web, upturned ends integral with the web, and sleeve means covering and including a part of the web intermediate the upturned ends. The sleeve may be a separate element which completely surrounds that portion of the web intermediate the upturned ends to be covered, or it may be made an integral part of the intermediate portion of the web, but releaseable therefrom. As for example, where a sleeve in cross-section has a portion thereof removed to present in cross-section a "C," whether round, square, triangular or other geometrical figure in cross-section. The arms of the "C" are made to cooperate with the web by engaging the longitudinal edges of the web and, thereby, the web and tube in combination present a closed geometric figure, such as a circle, a square, a triangle, and the like, remembering, however, that the jaws must releaseably engage the edges of said web. The contacting edges of the web and sleeve conveniently may have mating indicia to facilitate the positioning of the sleeve relative the web. The clip assembly may also have in addition to the upturned ends, upturned wings intermediate the ends and rising from the web. Conveniently, they may be approximately parallel to the ends.

The method of constructing a foundation stem on a foundation footing comprises the steps of providing foundation clips and sleeves, inserting the clips in the sleeves, positioning the clips and sleeves on the footing, inserting the forms in the clips, pouring concrete in the forms, removing the forms when the concrete has set up, and, finally, removing the clips from the sleeves for further use.

The advantages of the invention are that great savings in money can be achieved by using the clips many times over. The cost of the savings is a fraction of the savings realized.

BRIEF DESCRIPTION OF THE DRAWINGS

Turning now to the drawings in which the presently preferred embodiments of the invention are illustrated and from which further features and advantages will appear.

DETAILED DESCRIPTION OF THE PREFERRED EMBODIMENTS

Figure 1:
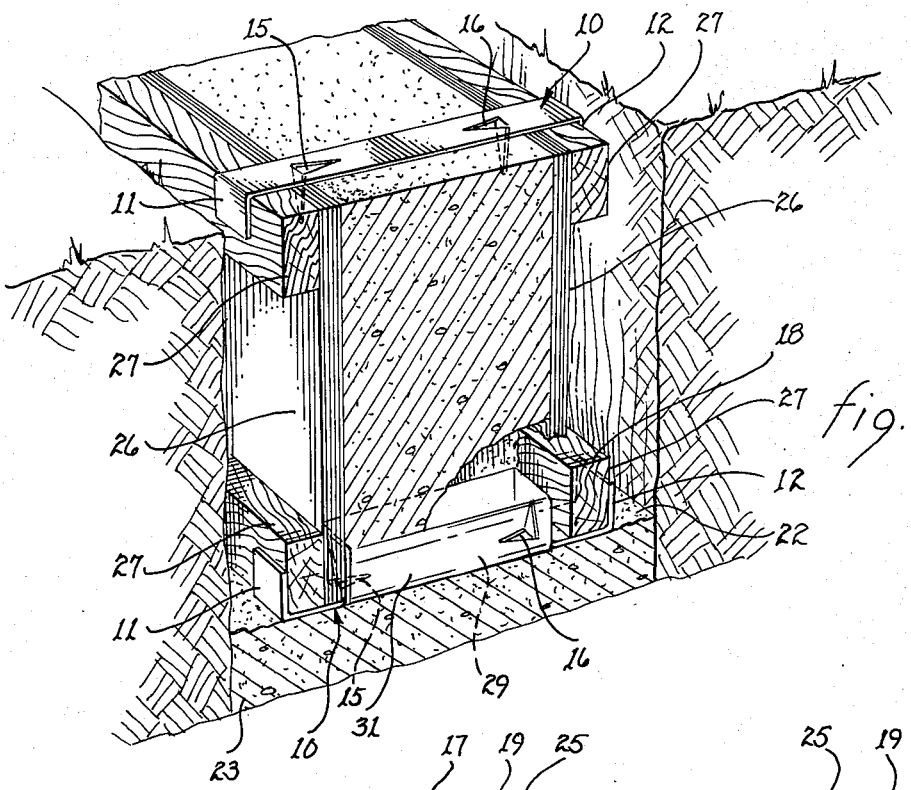
FIG. 1 is an enlarged perspective view showing the use of a foundation form clip incorporating the features of this invention.
Figure 2:
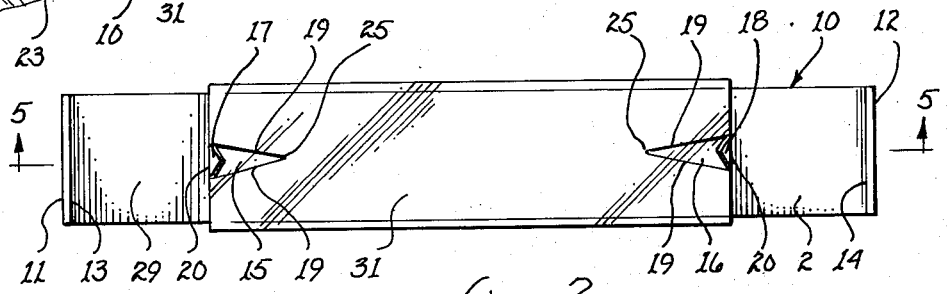
FIG. 2 is a plan view of the form clip shown in FIG. 1.

Turning now to FIGS. 1 through 4, wherein a first embodiment of this invention is shown, the foundation form clip assembly 1 has a web 10 and upturned ends 11, 12. In the web 10, intermediate the inside faces 13, 14 of the respective ends 11, 12, are triangular perforations 15, 16 formed by punching out the wings 17, 18 along the edges 19 and folding the wings upwardly on the line 20 to a substantially vertical position in the direction of extent of the ends 11, 12.

A tube 31 surrounds and axially encloses the web 10 extending from approximately line 20 at the base of the wings 17 to approximately line 20 at the base of the wings 18. In this configuration the cross-section of the sleeve is in the shape of a square. The width and height are greater than the ends 11, 12 and therefore sufficient to permit the withdrawal of the foundation form clip longitudinally therefrom after the concrete poured for the stem has set up and the forms are removed. The tunnels left in the base of the stem do not affect the strength of the stem, nor do they show after the earth is filled in around it. In the rare case when the bottom of the stem is designed to show, the tunnels can be sealed with a few trowelsful of mortar by the masons as they go along the wall.

Figure 5:
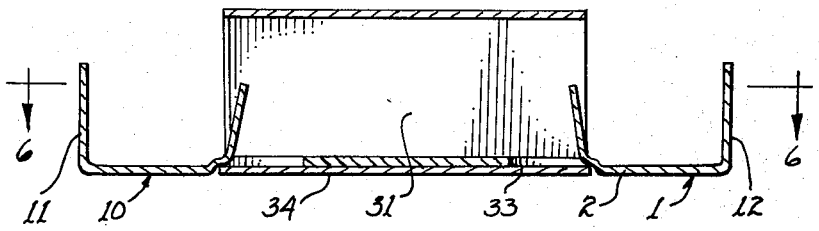
FIG. 5 is a view of a modification of the device of FIG. 1, in section, along the lines 5—5.

Turning now to FIG. 5 wherein a modification of the embodiment shown in FIGS. 1 to 4 is shown, the difference is that the central portion 33 of the web 10 is raised to accommodate the bottom 34 of the tube 31, such that the form clip assembly 1 lies flat on the surface 22 of the footing 23 throughout its length.

Figure 6:
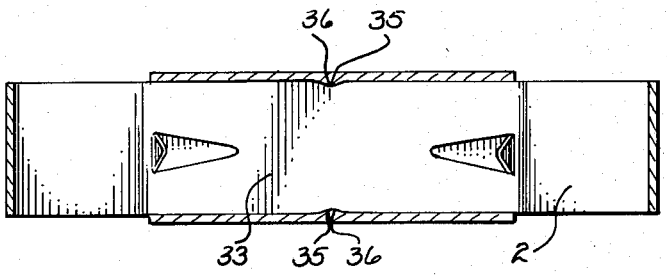
FIG. 6 is a view in section of the form clip of FIG. 5 along lines 6—6.

In FIG. 6 the central portion 33 is shown to have a slight indentation 35 with a corresponding boss 36 in the tube 31, by means of which the sleeve can be registered with the central portion 33 of the web 10 at a desired position. The mating indicia are small enough to avoid interfering with the withdrawal of the clip 2 from the sleeve. The clip 2 may be twisted or rotated slightly to disengage it from the frictional engagement of the sleeve 31, thereby making it easier to remove.

Figure 9:
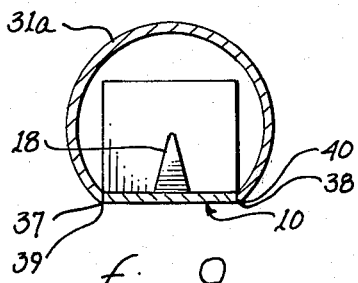
FIG. 9 is an end elevation view of the form clip assembly of FIG. 7 taken, in section, along the lines 9—9.
Figure 7:
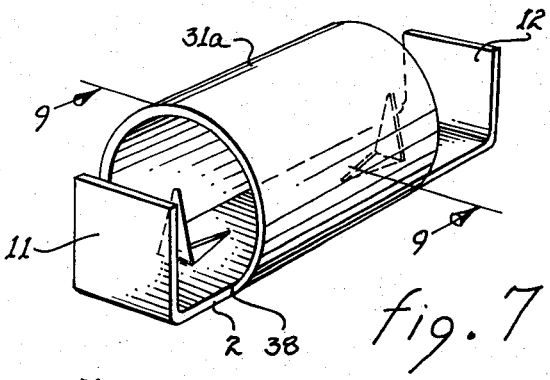
FIG. 7 is a perspective view of a third embodiment of the form clip assembly.
Figure 8:
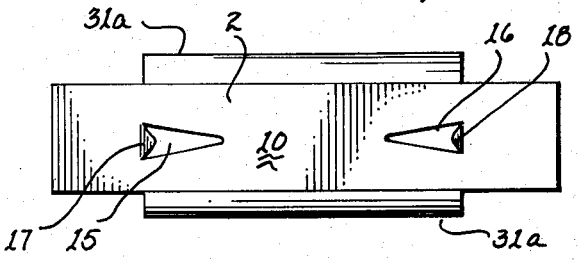
FIG. 8 is a bottom plan view of a form clip assembly of FIG. 7.

In FIGS. 7, 8 and 9 an alternative embodiment is shown which utilizes a sleeve 31*a* having a cross-section which is circular and in which a longitudinal portion of the sleeve has been removed, thereby creating a "C" shaped cross-section and longitudinal jaws 37, 38 in sleeve 31*a*. The jaws 37, 38 grip longitudinal edges 39, 40 of the web 10.

Figure 11:
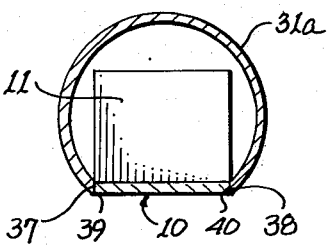
FIG. 11 is an end elevation view, in section, taken along the lines 11—11 of the form clip assembly of FIG. 10.
Figure 10:
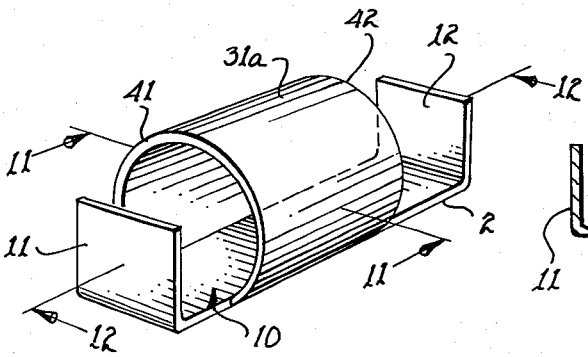
FIG. 10 is a fourth embodiment of the invention shown in perspective.
Figure 12:
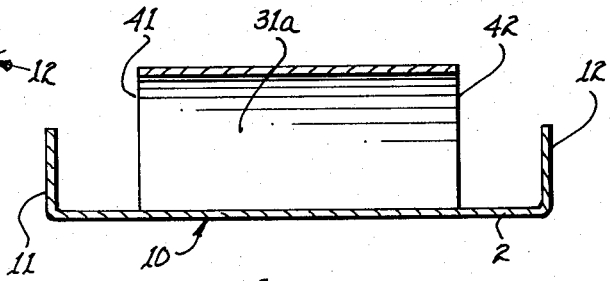
FIG. 12 is a side elevation view, in section, of the form clip assembly of FIG. 10, taken along the lines 12—12.

In FIGS. 10, 11 and 12 yet another alternative embodiment is illustrated wherein the wings 17, 18 are omitted and wherein the ends 41, 42 of the sleeve assume the function of the wings 17, 18.

Figure 3:
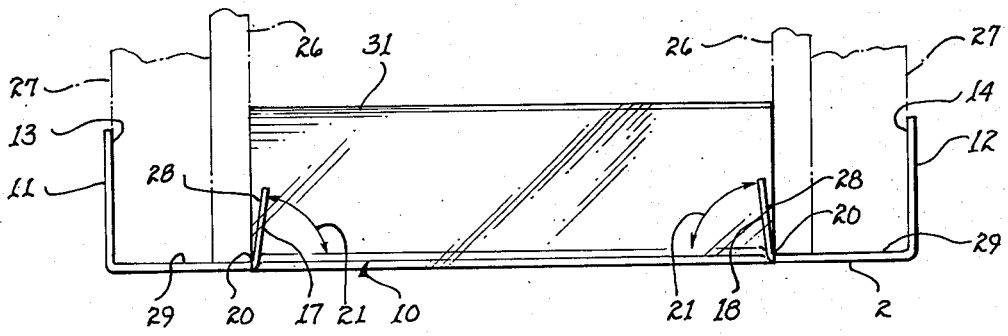
FIG. 3 is a side elevation view of the form clip shown in FIG. 2.
Figure 4:
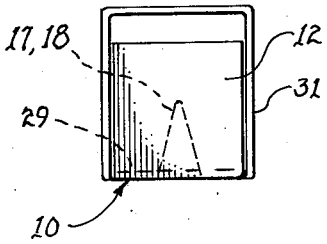
FIG. 4 is an end elevation view of the form clip shown in FIG. 2.

In use the clip assembly 1 is placed with its web 10 and the bottom 34 of the tube 31 resting on the top surface 22 of a foundation footing 23 with the ends 11, 12 and wings 17, 18 projecting upwardly. No nails are needed to secure the clip assembly to the concrete footing. Indeed, it is an advantage not to have the form clip assembly in place permanently so that adjustments to the orientation of the forms can be made just before the pouring of the concrete into the forms. The stem forms comprising plywood panels 26 and two-by-four support frame 27, fixed to the panels, are placed in the clip assemblies and on the footings as best shown in FIGS. 1 and 3. The clip without the tube 31 in place may be turned upside down and placed over the top edges of the form 26, 27 as shown in FIG. 1 for the purpose of securing the upper portions of the forms in alignment with the bottom edges. Concrete is then poured between the panels 26 in the usual manner to complete the foundation stem. The stem will show.

EXAMPLE I

A stem for a foundation of a building is constructed on a footing in the following manner:

Foundation clips and sleeves according to this invention are first provided. Then the clips are inserted into the sleeve. Next, the assembled clips and sleeves are positioned along the upper surface of the footing at appropriate intervals to provide guidance and support against lateral pressures of concrete to be poured in the form. Next, the concrete is poured into the form and after the concrete sets up sufficiently to retain its shape without support, the forms are removed, then the clips are removed from the sleeves for further use. The sleeves, which cost only a fraction of the value of the clip, are left in place.

The various and sundry embodiments disclosed in this invention and fully described herein constitute the presently preferred form of the invention. However, it is to be understood that the apparatus is capable of mechanical alteration in various equivalent forms without departing from the spirit of the invention and that such equivalent forms and commercial adaptations falling within the scope of the appended claims are intended to be included herein.

What is claimed is:

1. A foundation clip assembly comprising a clip comprising a web, upturned ends integral with said web, and sleeve means covering and including a part of said web intermediate the upturned ends, said sleeve means having a cross-section void larger than said clip in cross-section.

2. The clip assembly of claim 1 wherein said sleeve means comprises a tube axially enclosing a portion of said web.

3. The clip assembly of claim 1 wherein said sleeve means comprises a tube having a part of its circumference removed and presenting in cross-section a "C" configuration, the jaws of said "C" being adapted to releaseably engage the longitudinal edges of said web, whereby said web and tube, in combination, present a closed geometric figure.

4. The clip assembly of claim 3 wherein said closed geometric figure is a circle.

5. The clip assembly of claim 3 wherein the contacting edges of said web and said sleeve have mating indicia to facilitate positioning of said sleeve and web relative each other.

6. The clip assembly of claim 1 with the addition of upturned wings intermediate said ends.

7. The clip assembly of claim 2 with the addition of upturned wings intermediate said ends.

* * * * *